US005169726A

United States Patent [19]

Sato et al.

[11] Patent Number: 5,169,726

[45] Date of Patent: Dec. 8, 1992

[54] SURFACE TREATED MATERIALS OF EXCELLENT ADHESION FOR PAINTING LAYER,CORROSION RESISTANCE AFTER PAINTING, AND PRESS FORMABILITY, AS WELL AS A METHOD OF MANUFACTURING THEM

[75] Inventors: Hiroshi Sato; Kouki Ikeda, both of Kobe, Japan; Jun Hisamoto, Arlington, Mass.; Nagisa Takee, Nishinomiya, Japan

[73] Assignee: Kabushiki Kaisha Kobe Seiko Sho, Kobe, Japan

[21] Appl. No.: 747,967

[22] Filed: Aug. 21, 1991

[30] Foreign Application Priority Data

Aug. 22, 1990 [JP] Japan ..... 2-221648
Aug. 22, 1990 [JP] Japan ..... 2-221649

[51] Int. Cl.[5] ..... B32B 15/08

[52] U.S. Cl. ..... 428/463; 205/244; 205/259

[58] Field of Search ..... 428/457, 463; 204/44.2

[56] References Cited

U.S. PATENT DOCUMENTS 4,835,048 5/1989 Maeda et al. ..... 428/463 X
4,851,323 7/1989 Maeda ..... 428/421 X

*Primary Examiner*—Thomas J. Herbert, Jr.
*Attorney, Agent, or Firm*—Oblon, Spivak, McClelland, Maier & Neustadt

[57] ABSTRACT

The present invention discloses a surface treated material of excellent adhesion for painting layer, corrosion resistance after painting and press formability, containing, in a Zn or Fe series plating layer, a (meth)acrylic polymer having repeating units of a (meth)acrylic acid derivative in which a compound having an epoxy group is added to a chemical formula represented by:

where X represents —NH— or —O—, A represents $C_nH_{2n}$, n is 0 or a positive integer, R represents —H or —$CH_3$, and $R_1$, $R_2$ which may be identical or different with each other represents H or alkyl group.

5 Claims, 5 Drawing Sheets

SURFACE TREATED MATERIALS OF EXCELLENT ADHESION FOR PAINTING LAYER,CORROSION RESISTANCE AFTER PAINTING, AND PRESS FORMABILITY, AS WELL AS A METHOD OF MANUFACTURING THEM

BACKGROUND OF THE INVENTION

1. Field of the Invention

The surface treated material of the present invention is excellent in adhesion for painting layer, corrosion resistance after painting and press formability and it can be used in a wide range of application uses such as for automobiles, home electric appliances and building materials.

2. Description of the Prior Art

Metal materials represented by steel sheets are often used after applying plating with an aim of improvement for corrosion resistance, esthetic nature or the like. However, requirement for the properties or performances of platings such as corrosion resistance has been increased more and more along with a further development of technology and counter-measures has been carried out, therefor include, for example, (1) increase of deposition amount of plating, (2) use of Zn series alloys plating such as of Zn-Ni or Zn-Fe.

Further, in the application use as described above, painting is generally applied before use and it is also necessary to provide good adhesion for painting layer. However, since no sufficient adhesion for painted layer can be obtained in Zn or Fe series platings, a pre-treatment has been conducted by using phosphate, chromate or the like.

However, in the methods (1) and (2) above, so-called flaking or powdering is caused in which plating layers are peeled off upon press forming to result in troubles. Further, the pre-treatment for the painting makes the step complicate to increase the cost.

For overcoming the foregoing problems, dispersion of an organic or inorganic compound to the surface layer of the substrate or in the plating layer has been conducted (for example, in Japanese Patent Laid-Open Sho 61-127887, 61-264200 and Japanese Patent Publication Hei 1-36559), to obtain a considerably satisfactory result but no sufficient adhesion for painting layer and corrosion resistance after painting have yet been obtained.

The present invention has been accomplished in view of the foregoing situations and it is an object thereof to provide a surface treated material less suffering from degradation after painting and excellent in adhesion for painting layer, corrosion resistance after painting and press formability.

SUMMARY OF THE INVENTION

The surface treated material according to the present invention comprises Zn or Fe series plating layer, formed on the surface of a substrate, containing from 0.001 to 10% by weight, converted to the amount of carbon, of a (meth)acrylic polymer having more than 5 mol %, based on the entire repeating units, of repeating units of (meth)acrylic acid derivatives in which compound containing an epoxy group is added to a functional group represented by:

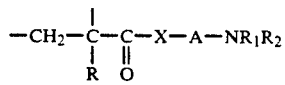

(I)

wherein X represents NH or O, A represents $C_nH_{2n}$, N is 0 or a positive integer and $R_1$ and $R_2$ which may be identical or different with each other represent H or alkyl group.

The present inventors have at first made a study on the properties necessary for the plating layers or the plating additives in order to obtain excellent adhesion for painting layer, corrosion resistance after painting and press formability respectively and, as a result, have reached the following knowledges.

ADHESION FOR PAINTING LAYER AND CORROSION RESISTANCE AFTER PAINTING

It is desirable that additives are co-deposited and dispersed in plating layers to form chemical bonds with respect to painting ingredients during painting and that the bonds should be kept and suffer from no degradation even under a corrosive circumstance.

PRESS FORMABILITY

It is desirable that the plating layer has some hardness and lubricating property to some extent.

As a result of earnest studies based on the above-mentioned knowledges, the surface treated material according to the present invention having excellent performance can be attained.

Description will be made to the contents.

In the present invention, a specific organic compound is dispersed and codeposited in a plating layer with an aim of providing the surface of the plating layer with a polarity. The organic compound is a (meth)acrylic polymer containing more than 5mol%, based on the entire repeating units, of a (meth)acrylic acid derivative unit having a group of a compound having an epoxy group added to a functional group represented by the formula (I) described above. The polarity or producing chemical bondings, which contribute to excellent property, are given by the functional group will be mentioned below.

Description will be made at first to —$C_nH_{2n}$—(n is a positive integer) and an alkyl group in the above-mentioned definition.

—$C_nH_{2n}$—may be linear or branched and typical examples include, for example, methylene, ethylene, trimethylene, tetramethylene, pentamethylene, hexamethylen, propylene and ethylethylene, those having n of less than 6 being particularly preferred.

The alkyl group may also be linear or branched and typical examples include, for example, methyl, ethyl, propyl, isopropyl, butyl, tert-butyl, pentyl and hexyl, a lower alkyl being particularly preferred.

As the (meth)acrylic acid derivative having the functional group shown by the formula (I) and to which an epoxy-group containing compound is added can include, for example, methylaminoethyl acrylamide, methylethylaminoethyl acrylamide, dipropylaminopropyl acrylamide, dimethylaminopropyl methacrylamide, diethylaminoethyl methacrylamide, dimethylaminoethyl methacrylamide, dimethyl hydrazide acrylate, as well as dimethylaminoethyl methacrylate, methylethylaminoethyl methacrylate, dimethylaminopropyl acrylate, diethylaminoethyl acrylate and dimethylaminoethyl acrylate. Above-mentioned examples contain tertiary amino group in the terminal amino group but those containing primary amino group or secondary amino group such as methylamino or ethylamino should also be included in the present invention.

The compound containing the epoxy added to the (meth)acrylic acid derivative as exemplified above can include, for example, bisphenol-A glycidyl ether, epichlorohydrin, arylglycidyl ether, styrene oxide, phenyl glycidyl ether and glycidyl acetate. There is no particular restriction on the combination when they are added. Especially in all of epoxy added group, however, appliance of epichlorohydrin should produce the excellent performance.

The (meth)acrylic polymer according to the present invention contains the compound to be prepared as described above by more than 5 mol% as the monomer unit as described previously. Although it includes a case where the monomer unit is contained by 100 mol%, but other copolymerizable compounds than the above-mentioned compounds may be contained, if desired, as the monomer unit in the constituent unit. As such a monomer ingredient, there can be mentioned, for example, (meth)acrylic amide or ester compound such as acrylamide, methacrylamide, methyl acrylate and methyl methacrylate.

By the way, the reaction of addition the compound containing the epoxy group may be carried out before polymerization but, most generally, a method of reacting the epoxy type compound after forming a polymer by homopolymerization or copolymerization of the monomers is recommended for instance. It is considered that the functional group of the amino series is quaternarized by the addition.

In the addition reaction, the effect of the present invention can be attained by incorporating more than 5 mol % and, preferably, more than 10 mol % of the unit to which the epoxy group-containing compound is added in the polymer. FIG. 1 shows a relationship between the modification ratio of an epoxy group unit and the peeling width of painting layer (corrosion resistance after painting) and FIG. 2 shows a relationship between the modification ratio of the epoxy group unit and the peeling rate of painting layer (adhesion of painted layer). The polymers applied in the experiment shown in FIG. 1 are a copolymer comprising a mixture prepared by adding epichlorohydrin to dimethylamino ethyl methacrylate and an acrylamide (hereinafter sometimes referred to as a polymer 1, and indicated by "○") and a polymer comprising a mixture prepared by adding epichlorohydrin to dimethylamino ethyl methacrylamide and acrylamide (hereinafter sometimes referred to as a polymer 2, and indicated by "○").

When the modification ratio is less than 5 mol %, no excellent effect could be obtained. The peeling width for painting layer and the peeling rate for painting layer were measured by the methods shown in examples.

There is no particular restriction for the size of the polymer itself and it is desirable that the polymer has a molecular weight between 1,000 and 1,000,000. When the substance of such a size is codeposited and dispersed in the plating layer, it is possible to cause internal stresses in the plating layer to improve the hardness to some extent thereof. Further, since, according to these appliances, organic compounds have lubricating property and the role as a buffer, which will be mentioned later, and the press formability of the prepared plating layer can also be improved remarkably.

The organic compound according to the present invention having the foregoing constitution, being improved with the polarity due to the epoxy group or the amino group, is dispersed stably as a solution without suspension like colloid involved even in acidic plating solution at pH of 1 to 4, and the characteristic thereof can be maintained after codeposited in the plating layer. Further, in a case where X in the formula (I) is NH, it has a structure having a group to which both the amide group and the epoxy group are added, accordingly, it is possible to control and restrain the degradation of the organic compound by salting out even in a solution in which a great amount of metal ions are involved and enables continuous electrolytic operation over a long time period. Further more, since the organic compound can control the electric current localization due to micro or macro roughness of a substrate surface or something like during electrolytic formation of plating layers, in particular, under the condition of high current density, it can contribute to the production of uniformed and smooth surface treatment layers, and is also able to provide an appearance of uniform brightness. Further, since epoxy groups or the hydroxy groups formed by the addition of the epoxy groups present in the plating layer form crosslinkings due to the polarity or chemical bondings with respect to the painting material upon baking of the painting (at a temperature of higher than 80° C.), the resultant plating layer has high adhesion between the painting layer. In addition, since the plating layer contains the (meth)acrylic acid derivative polymer to which the epoxycompound is added according to the present invention, it shows excellent corrosion resistance after painting, because of the reason mentioned above, forming those bondings. These bondings should be kept and suffer from no degradation or deterioration even under corrosive conditions. Further, by codeposition and dispersing the polymer into the plating layer, the plating layer can be provided with hardness to some extent as described above as, at the same time, the lubricating property of the additives itself can be provided. Still more, polymer is codeposited in plating layer having micro scale volume which depends on the molecular weight. In these codeposited conditions, polymer works also as a buffer to prevent from the stresses during press forming, especially mitigation of the compressive stress, and contribute to the presence of excellent press formability. Accordingly, the press formability of the plating layer can be improved remarkably.

Description will now be made to a method of codeposition of organic compound into the plating layer in the present invention. There is no particular restriction for the plating method, and electric plating or the like maybe adopted as required. For instance, the plating can be conducted electrolytically by using an acidic Zn or Zn series alloy, or Fe or Fe series alloy plating solution containing the organic compound at a concentration of 1.01 to 200 g/l. FIG. 3 shows a relationship between the content of the organic compound in the plating solution and the peeling rate of painting layer and FIG. 4 shows a relationship between the content of the organic compound in the plating solution and the peeling amount of plating layer. No sufficient effect can be obtained if the concentration of the organic compound in the plating solution is too low. On the other hand, if it is too high, the viscosity of the plating solution is increased to make the supply of metal ions to the surface of the substrate to be treated insufficient, as well as excess adsorption of the organic compound to the surface of the substrate to be treated rather causes plating failure to deteriorate the appearance. These failure results in undesired effects on the painting property, the corrosion resistance after painting and the press formability.

Further, in order to provide a sufficient effect as described above, it is necessary that the codeposited organic compound is contained by from 0.001 to 10% by weight, more preferably, from 0.01 to 5% by weight, converted to the amount of carbon in the plating layer. FIG. 5 shows the relationship between the polymer content as the amount of carbon in plating layer and the peeling rate of painting layer by paint adhesion test, FIG. 6 shows a relationship between the polymer content as carbon amount in the plating layer and the peeling amount of plating layer by press forming test and FIG. 7 shows a relationship between the polymer content as the amount of carbon in the plating layer and the peeling width of painting layer by the test of corrosion resistance after painting. If the content is too low, no sufficient effect can be obtained, whereas if it is too high, it may result in the peeling of plating during press forming.

EXAMPLES

Figure 1:
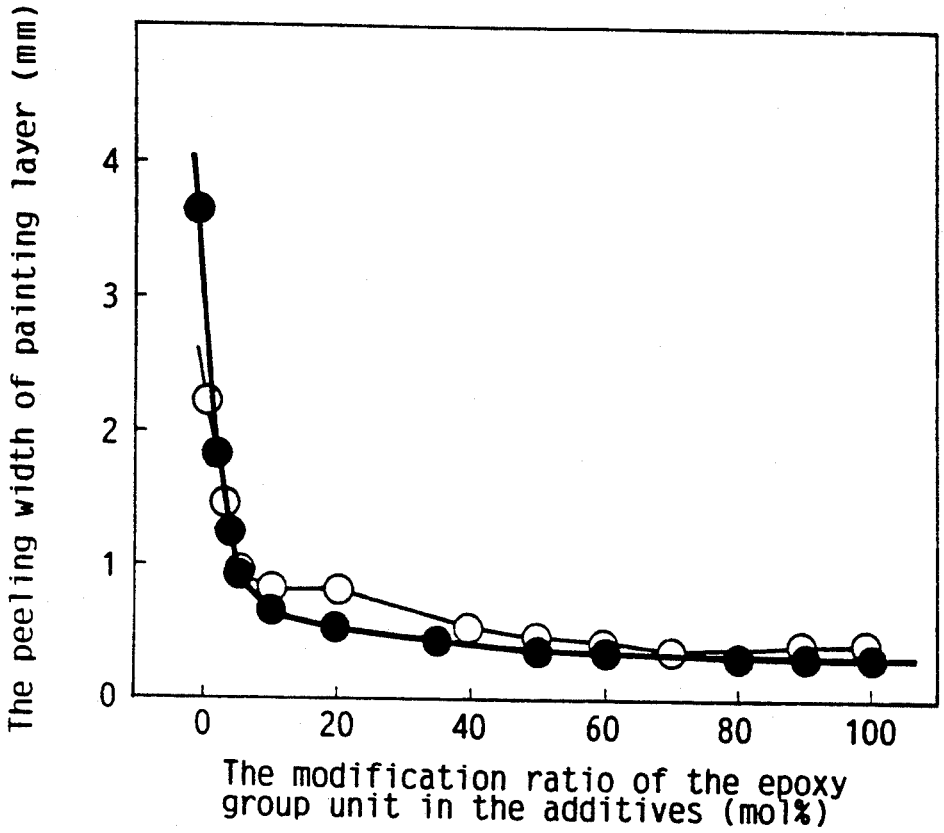
FIG. 1 shows the relationship between the modification ratio of the epoxy group unit in the additives and the peeling width of painting layer by the test of corrosion resistance after painting.
Figure 2:
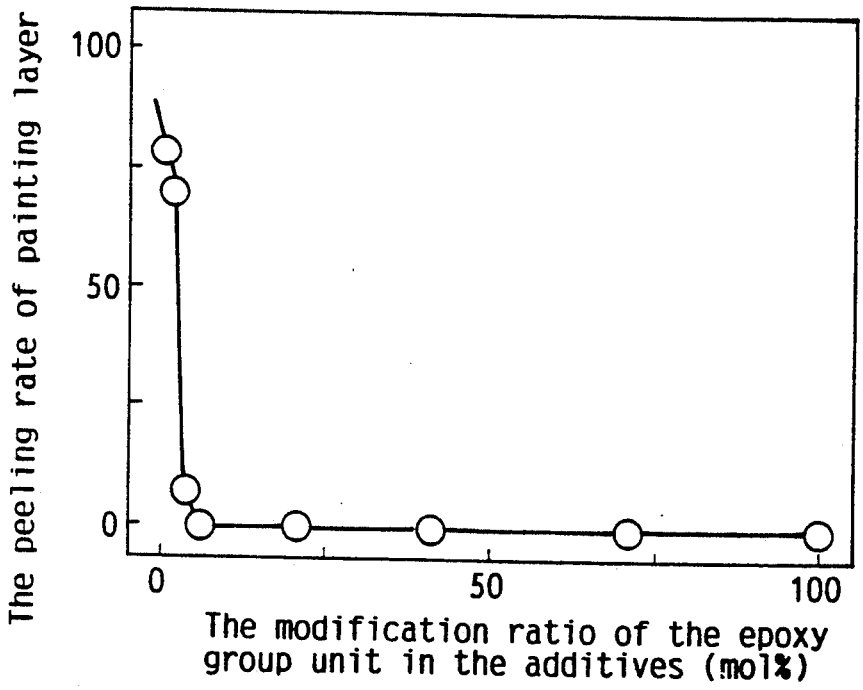
FIG. 2 shows the relationship between the modification ratio of the epoxy group unit in the additives and the peeling rate of painting layer by paint adhesion test.
Figure 3:
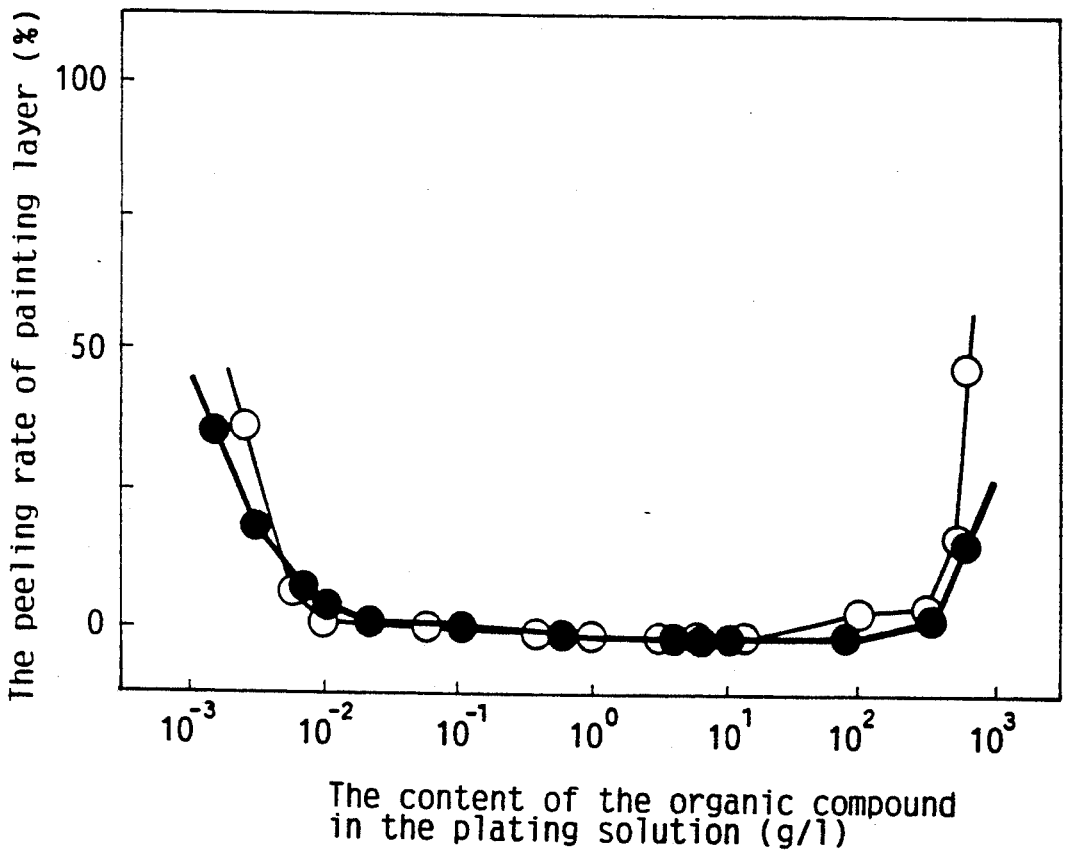
FIG. 3 shows the relationship between the content of the organic compound in the plating solution and the peeling rate of painting layer by paint adhesion test.
Figure 4:
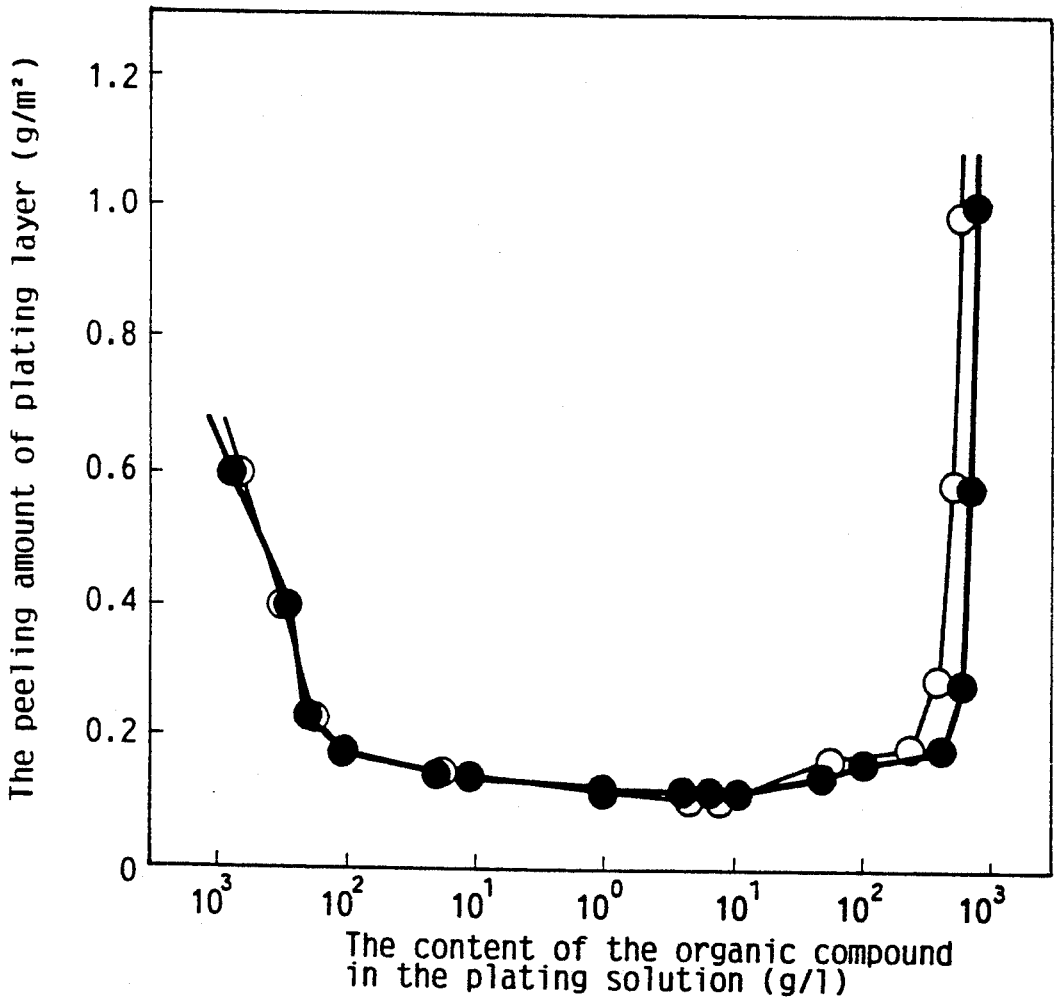
FIG. 4 shows the relationship between the content of the organic compound in the plating solution and the peeling amount of plating layer by draw bead test.
Figure 5:
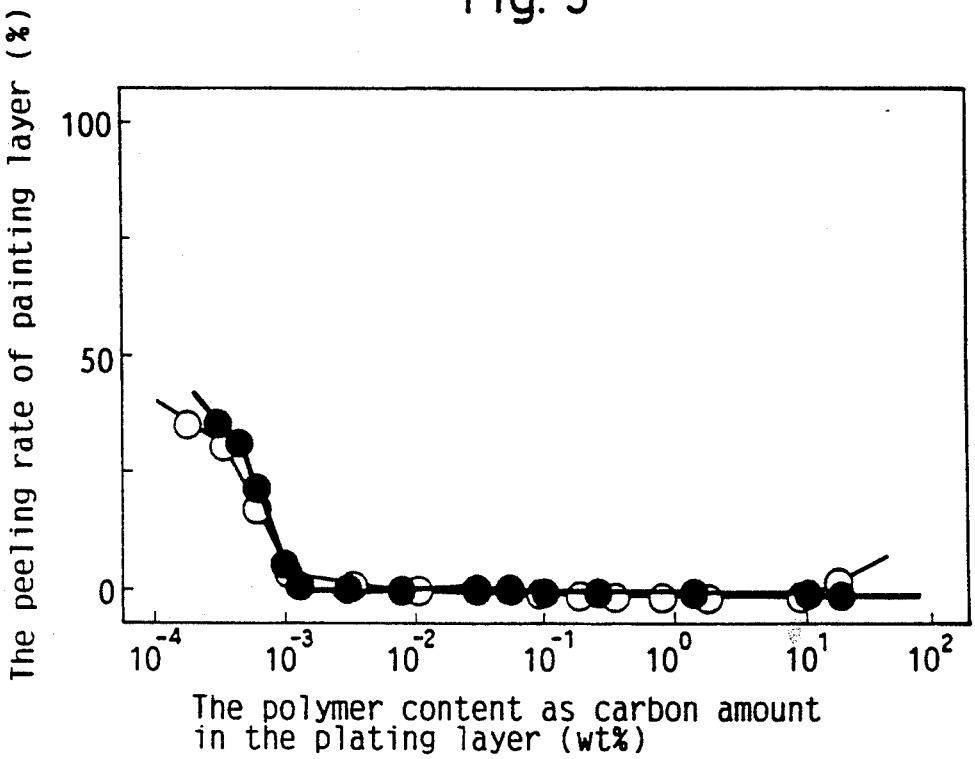
FIG. 5 shows the relationship between the polymer content as carbon amount in the plating layer and the peeling rate of painting layer by paint adhesion test.
Figure 7:
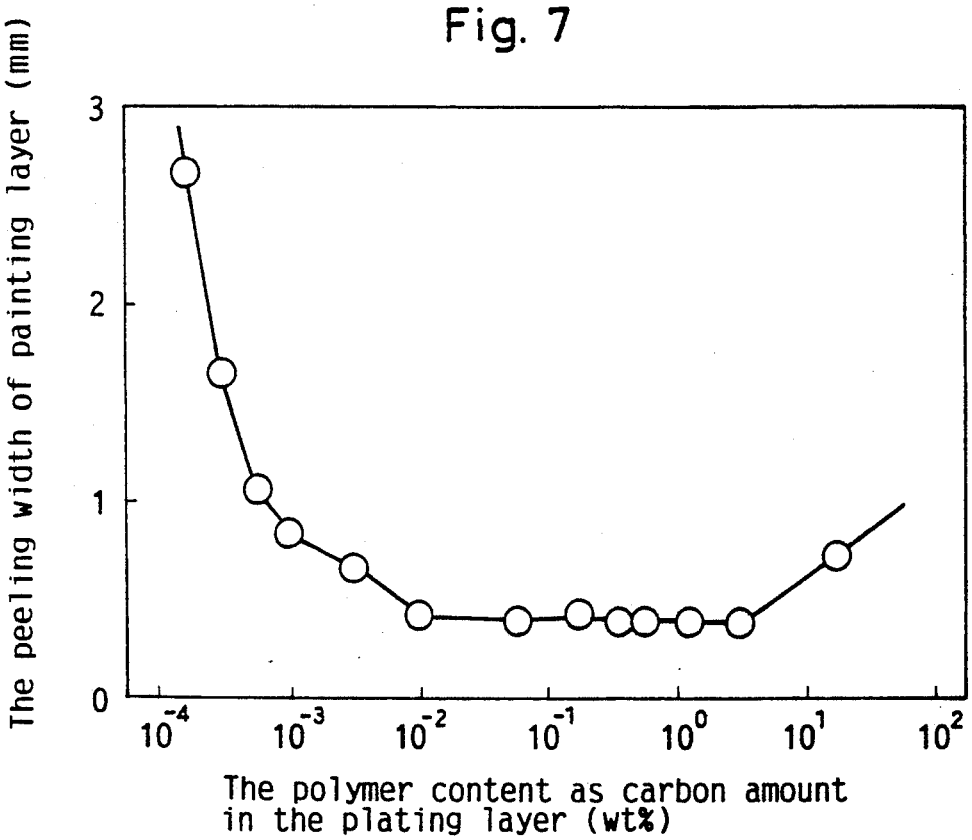
FIG. 7 shows the relationship between the polymer content as carbon amount in the plating layer and the peeling width of painting layer by the test of corrosion resistance after painting.
Figure 6:
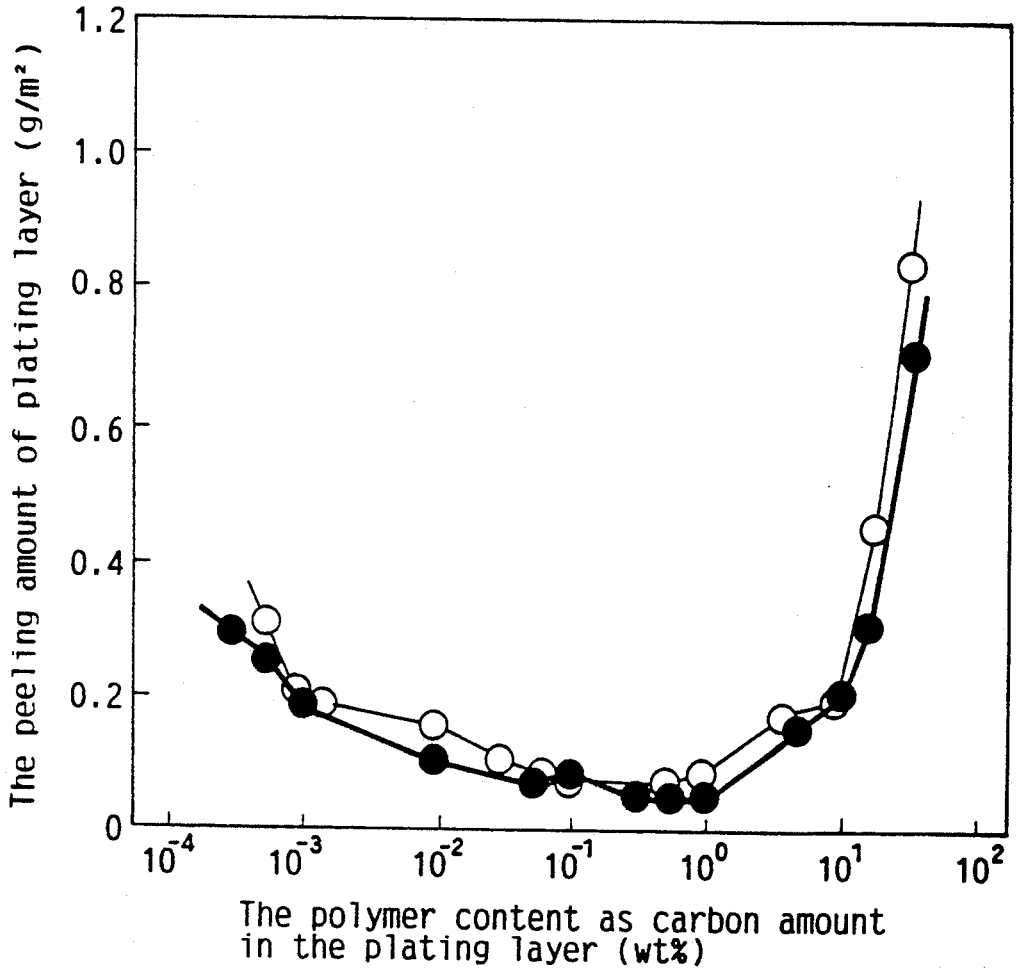
FIG. 6 shows the relationship between the polymer content as carbon amount in the plating layer and the peeling amount of plating layer by draw bead test.

Plating as shown in Table 1 was applied to cold rolled steel sheets prepared with a pre-treatment of degreasing pickling. Electrogalvanized or electroplated steel sheets respectively can be also applied with appropriate pretreatment as the substrates. Plating treatment was applied electrolytically by using the substrate as a cathode and under a current density of 0.1 to 200 $A \cdot dm^{-2}$.

The resultant steel sheets treated with plating were evaluated for the adhesion for painting layer (paint adhesion), corrosion resistance after painting and press formability by the following methods. As the additives according to the present invention, the polymers 1 and 2 described above were used as typical examples.

EVALUATION METHOD

Paint Adhesion Property (Adhesion for Painting Layer)

An alkyd-melamine type paint was coated directly to the plated layer and a score-cut Erichsen tape peeling off test was conducted to evaluate the adhesion property based on the peeling rate for painting layer.

○: peeling rate for painting layer; less than 5%
Δ: peeling rate for painting layer; 5–30%
x: peeling rate for painting layer; more than 30%

CORROSION RESISTANCE AFTER PAINTING

An alkyd-melamine type paint was coated directly to the plating layer and, 24 hours after cross cut SST (Salt Spray Test), tape peeling off test was conducted and the corrosion resistance was evaluated based on the peeling width of painting layer.

○: peeling width of painting layer; less than 1 mm
Δ: peeling width of painting layer; 1–2 mm
x: peeling width of painting layer; more than 2 mm

PRESS FORMABILITY

A draw bead test was conducted to investigate the peeling amount of plating layer.

○: peeling amount of plating layer; less than 0.2 $g/m^2$
Δ: peeling amount of plating layer; 0.2 to 0.5 $g/m^2$
x: peeling amount of plating layer; more than 0.5 $g/m^2$ The results are shown in Table 1 and Table 2.

TABLE 1

| | Organic compound | | | | | | | | | |
|---|---|---|---|---|---|---|---|---|---|---|
| No. | Type[1)] | Molecular weight | Modification ratio (mol %) | Addition amount (g/l) | Content (wt %) | Type of plating | Substrate[2)] | Adhesion for painting layer | Corrosion resistance after painting | Press formability |
| Example | | | | | | | | | | |
| 1 | A | 400,000 | 20 | 8 | 0.6 | Zn | cold rolled steel sheet | ○ | ○ | ○ |
| 2 | A | 2,000 | 50 | 60 | 1.8 | Zn—Ni | electric Zn—Ni | ○ | ○ | ○ |
| 3 | A | 300,000 | 50 | 10 | 0.6 | Zn | GA | ○ | ○ | ○ |
| 4 | A | 1,000,000 | 6 | 150 | 3.5 | Zn—Fe | GA | ○ | ○ | ○ |
| 5 | A | 20,000 | 25 | 0.02 | 0.005 | Zn | GI | ○ | ○ | ○ |
| 6 | A | 500,000 | 100 | 10 | 0.8 | Zn—Fe | electric Zn | ○ | ○ | ○ |
| 7 | A | 9,000 | 30 | 20 | 1.5 | Zn | electric Zn | ○ | ○ | ○ |
| 8 | A | 100,000 | 80 | 0.9 | 0.06 | Zn—Cr | cold rolled steel sheet | ○ | ○ | ○ |
| 9 | A | 300,000 | 50 | 7 | 0.5 | Zn—Mn | cold rolled steel sheet | ○ | ○ | ○ |
| 10 | B | 300,000 | 10 | 0.2 | 0.01 | Zn—Ni | electric Zn | ○ | ○ | ○ |
| 11 | B | 1,500 | 70 | 10 | 1.8 | Zn—Ni | electric Zn—Ni | ○ | ○ | ○ |
| 12 | B | 300,000 | 50 | 7 | 0.6 | Zn | GA | ○ | ○ | ○ |
| 13 | B | 1,000,000 | 6 | 140 | 7.8 | Zn—Fe | GA | ○ | ○ | ○ |
| 14 | B | 20,000 | 25 | 0.03 | 0.005 | Zn | GI | ○ | ○ | ○ |

TABLE 1-continued

| No. | Organic compound Type[1)] | Molecular weight | Modification ratio (mol %) | Addition amount (g/l) | Content (wt %) | Type of plating | Substrate[2)] | Adhesion for painting layer | Corrosion resistance after painting | Press formability |
|---|---|---|---|---|---|---|---|---|---|---|
| 15 | B | 500,000 | 100 | 5 | 0.8 | Zn—Fe | electric Zn | ○ | ○ | ○ |

[1)]A: polymer-2. B: polymer-1
[2)]GA: Galvannealed steel sheet (alloyed hot dip galvinized steel sheet)
GI: Hot dip galvanized steel sheet

TABLE 2

| No. | Organic compound Type[1)] | Molecular weight | Modification ratio (mol %) | Addition amount (g/l) | Content (wt %) | Type of plating | Substrate[2)] | Adhesion for painting layer | Corrosion resistance after painting | Press formability |
|---|---|---|---|---|---|---|---|---|---|---|
| Example | | | | | | | | | | |
| 16 | B | 9,000 | 30 | 10 | 1.5 | Zn | cold rolled steel sheet | ○ | ○ | ○ |
| 17 | B | 300,000 | 80 | 10 | 0.8 | Zn—Cr | cold rolled steel sheet | ○ | ○ | ○ |
| 18 | B | 250,000 | 40 | 8 | 0.7 | Zn—Mn | cold rolled steel sheet | ○ | ○ | ○ |
| Comparative Example | | | | | | | | | | |
| 19 | A | 300,000 | 4 | 10 | 0.8 | Zn | electric Zn | Δ | X | ○ |
| 20 | B | 300,000 | 4 | 9 | 0.8 | Zn | electric Zn | Δ | X | ○ |
| 21 | A | 800 | 25 | 70 | 1.8 | Zn—Fe | electric Zn—Ni | ○ | Δ | X |
| 22 | B | 800 | 25 | 12 | 1.8 | Zn—Ni | electric Zn—Ni | ○ | Δ | X |
| 23 | A | 250,000 | 30 | 0.008 | 0.0008 | Zn—Ni | GI | X | X | Δ |
| 24 | B | 250,000 | 30 | 0.008 | 0.0008 | Zn | GA | X | X | Δ |
| 26 | A | 300,000 | 50 | 210 | 12.5 | Zn—Fe | GA | ○ | Δ | X |
| 27 | B | 300,000 | 50 | 220 | 12.5 | Zn—Fe | GI | ○ | Δ | X |
| 28 | — | — | — | — | — | Zn | electric Zn | X | X | Δ |
| 29 | — | — | — | — | — | — | GI | X | X | X |
| 30 | C | — | — | 5 | 0.4 | Zn | cold rolled steel sheet | Δ | X | Δ |
| 31 | D | — | — | 10 | 0.7 | Zn—Fe | cold rolled steel sheet | Δ | Δ | Δ |
| 32 | D | — | — | 10 | 1.2 | Zn—Ni | cold rolled steel sheet | Δ | Δ | Δ |

[1)]A: polymer-2. B: polymer-1. C: cationically modified polyamide. D: nonionic polyamide
[2)]GA: Galvannealed steel sheet (alloyed hot dip galvanized steel sheet)
GI: Hot dip galvanized steel sheet As shown in Tables 1 and 2, examples (Nos. 1-18) using the additives according to the present invention are excellent in the adhesion for painted layer, the corrosion resistance after painting and press formability.

On the other hand, comparative examples Nos. 19 and 20 show modification ratio of less than 5 mol % and poor corrosion resistance after painting, Nos. 21 and 22 having molecular weight of less than 1000 show poor press formability, Nos. 23 and 24 having low content of the organic compound show poor adhesion for painting layer and corrosion resistance after painting, Nos. 25 and 26 having high content of organic compound show poor corrosion resistance after painting and press formability, Nos. 27 and 29, not containing the organic compound and Nos. 29 to 31, using the organic compound other than that of the present invention, show poor adhesion for painting layer, corrosion resistance after painting and press formability.

What is claimed is:

1. A surface treated material of excellent adhesion property for painting layer and corrosion resistance after painting having a Zn or Fe series plating layer formed on the surface of substrate and comprising from 0.001 to 10% by weight, converted to the amount of carbon, of a (meth)acrylic polymer with more than 5 mol %, based on the entire repeating units, of repeating units of a (meth)acrylic acid derivative in which a compound having an epoxy group is added to a chemical formula represented by:

$$-CH_2-\underset{\underset{R}{|}}{\overset{|}{C}}-\underset{\underset{O}{\|}}{C}-X-A-NR_1R_2$$

where X represents —NH— or —O—, A represents $C_2H_{2n}$, n is 0 or a positive integer, R represents —H or —$CH_3$, and $R_1$, $R_2$ which may be identical or different with each other each represents H or alkyl group.

2. A surface treated material as defined in claim 1, wherein the repeating units of the (meth)acrylic acid derivative is more than 10 mol % of the entire repeating units.

3. A surface treated material as defined in claim 1, which comprises a plating layer containing from 0.01 to 5% by weight of the (meth)acrylic polymer as the amount of carbon.

4. A surface treated material as defined in claim 1, wherein the average molecular weight of the (meth)acrylic polymer is from 1000 to 1,000,000.

5. A surface treated material as defined in claim 1, wherein the repeating units of the (meth)acrylic acid derivative have quaternary nitrogen.

* * * * *